US009259109B2

(12) United States Patent
Samenuk et al.

(10) Patent No.: US 9,259,109 B2
(45) Date of Patent: Feb. 16, 2016

(54) DINING PLATE AND METHOD FOR USE TO PROVIDE CUSTOMIZABLE AND PERSONALIZED DINING EXPERIENCES

(75) Inventors: Ann Samenuk, Ridgefield, CT (US); Sean W. Higgins, Richmond, VA (US); Bruce S. Ferris, Richmond, VA (US)

(73) Assignee: You cANN & Co., LLC, Ridgefield, CT (US)

( * ) Notice: Subject to any disclaimer, the term of this patent is extended or adjusted under 35 U.S.C. 154(b) by 179 days.

(21) Appl. No.: 13/343,915

(22) Filed: Jan. 5, 2012

(65) Prior Publication Data

US 2012/0171647 A1 Jul. 5, 2012

Related U.S. Application Data

(60) Provisional application No. 61/430,010, filed on Jan. 5, 2011.

(51) Int. Cl.
*G09B 19/00* (2006.01)
*A47G 19/02* (2006.01)

(52) U.S. Cl.
CPC ..... *A47G 19/025* (2013.01)

(58) Field of Classification Search
USPC ..... 434/127; 220/574, 574.3, 575
See application file for complete search history.

(56) References Cited

U.S. PATENT DOCUMENTS 3,515,262 A * 6/1970 Ornstein et al. ..... 206/217
5,560,653 A * 10/1996 Beppu ..... 283/117
6,296,488 B1 * 10/2001 Brenkus et al. ..... 434/127
7,673,753 B1 * 3/2010 Huckert ..... 206/541
2005/0016887 A1 * 1/2005 Yewdall et al. ..... 206/440
2012/0048874 A1 * 3/2012 Oakes et al. ..... 220/839

FOREIGN PATENT DOCUMENTS

DE 20310817 10/2003
WO 0215757 2/2002
WO WO 0215757 A1 * 2/2002

OTHER PUBLICATIONS

"Types of Plastics in Tupperware Products and Recycling Codes". Jun. 3, 2010. Retrieved Nov. 19, 2013 from <url: http://order.tupperware.com/coe-pdf/tupp_2010_materials.pdf>.*
EZScreen. "Understanding IP and NEMA Ratings". Dec. 15, 2004. Retreived Jun. 14, 2014 from <URL: http://web.archive.org/web/20041215192157/http://www.erscreen.com/ip_ratings.htm>.*
(Continued)

*Primary Examiner* — Sam Yao
*Assistant Examiner* — Peter J Alley
(74) *Attorney, Agent, or Firm* — Pepper Hamilton LLP

(57) ABSTRACT

A dining plate includes a top portion with a substantially transparent window therein. The plate also includes a bottom portion with a bottom surface having a first outside receiving groove and second inside receiving groove. The bottom portion has a generally planar shape that corresponds generally to the shape of the top portion. The bottom portion also has a top surface with a continuous inner standing rib and an outward rim. The top and bottom portions are joined together so that the inner standing rib is releaseably positioned in the inside receiving groove and the outward rim is releaseably positioned in the outside receiving groove. A substantially watertight cavity is formed between a central section of each of the top and bottom portions. The cavity is aligned with the window in the top portion.

18 Claims, 11 Drawing Sheets

(56) References Cited

OTHER PUBLICATIONS

Medical News Today. "What Is BPA (Bisphenol A)? Is BPA Harmful?". Originally published Apr. 4, 2011. Retrieved Jun. 14, 2014 from <URL: http://www.medicalnewstoday.com/articles/221205.php>.*

Written Opinion and Search Report; PCT Application No. PCT/US2012/020285; mailing date May 18, 2012; 9 pages.

* cited by examiner

DINING PLATE AND METHOD FOR USE TO PROVIDE CUSTOMIZABLE AND PERSONALIZED DINING EXPERIENCES

This application claims the benefit of U.S. Provisional Patent Application. Ser. No. 61/430,010 filed Jan. 5, 2011, which is, incorporated by referenced herein in its entirety.

The field of this invention is dining plates having a cavity therein. Specifically, the cavity is accessible by a user to allow a user to removeably insert a picture or a message in the cavity that is then visible to the user of a plate through a window in the surface of the plate. In addition to the plate alone, the present invention is directed to a method of using the plate in a diet. A user is able to place motivational pictures or other messages in the cavity in the plate and have view of them. These visuals are fresh and proximate reminders of one's body image prompting the user to reach his or her diet goal whenever the plate is being; used for a meal.

BACKGROUND

Decorative plates have been long-known since almost the earliest days of mankind. Plates have their original artwork that painted or glazed or otherwise inked on the surface of the plate. Photographs have been screen printed onto plates. Additionally, words and messages also appear on plates, typically printed or otherwise layered onto the surface of the plate and permanently fixed onto it.

Traditional picture frames axe also, of course, long-known. Pictures, artwork, words and messages are commonly displayed through the use of a broad range of picture frames. Typically, these frames are only suitable for hanging or other conventional display.

Dieting can be a challenging process for any dieter for a wide variety of reasons. Much, diet advice is available, but it is difficult to personalize any such advice during actual meal time. Usually, a dieter is only provided with socially accepted and idealized pictures of models and generic inspirational messages. It is difficult to find individually-focused information when the time comes to actually serve and eat a meal. For instance, generic plates having generic inspirational messages or other diet information are known and available. These plates are not individually-focused.

SUMMARY

In summary, the present invention includes a dining plate, specifically a two part plate system, comprised of a transparent top portion and an elastomeric non-transparent bottom portion. A unique fluid and continuous double seal, between the top portion and a removable bottom, portion of the plate, creates a compression and sufficient friction to engage the portions in an impermeable seal. When assembled, the unique press-in double seal creates a water resistant central cavity to secure a photo or the like.

An impermeable seal engages the two portions by applied hand heel pressure around the periphery of the bottom portion. Disengagement of the two part interface results by hand lifting the bottom portion at any point along the periphery.

It is of course understood that the dinner plate top portion may be of any circular dimensional size or any geometry of combined angles and sides. The geometry of the dinnerware top portion, inside and outside receiving grooves therefor determine and define the shape and size of the bottom portion and its compatible male components, the outer rim with a bulbous tip and an inner standing rib.

The essence of the sealing closure is the engineered design construction and plastic material characteristics for the top portion and the bottom portion, individually and in combination with each other. The physical characteristics of the plastic materials used such as a rigid copolyester top portion and a flexible elastomer bottom portion, or other materials having similar properties of hardness, indentation or lack of indentation, elasticity or specific distortability, are directly proportionate to each other in the design construction.

As the intent of the plate is to hold a photograph or the like that may be moisture sensitive, the seal between the two portions should preferably be impermeable but alternatively be substantially or nearly impermeable to create a moisture barrier to match with the sensitivity of the object placed in the cavity between the two portions, to protect against the damaging effects of water. The impermeability of the seal created when the portions are engaged or mated is measured by water ingress rates through the seal. There are various techniques to measure water ingression; however, as the intent of the seal is not to be selectively impermeable, the test would apply an acceptable rate of water ingress, so as to strive for obstruction of water entering the first outer groove seal, and positively obstruct water from entering or passing through the second or double rib seal. Optimally, the assembled plate should be both hand wash or dishwasher safe. The degree of water ingression, or leaks into the central cavity, is relative only to the end use and does not imply acceptability of any water ingress. The individual application will dictate the level of seal integrity or reliability needed. For many receptacle uses, only large leaks of water ingress would be considered unacceptable and the ability to detect minute leaks is of little or no consequence.

Water ingress that creates a damaging effect on the object contained within the cavity, tested under conditions of high power water-jet streams which make exterior contact with the seal from any direction, or of immersion in water, or typical handheld washing conditions would be considered unacceptable, as an object of the present design is a seal that will create a water resistant central cavity. However, many water ingress tests are conducted only once using fixed conditions such as: specific periods of exposure time, specific water depths, specific and controlled force of pressure. Therefore, qualifying the plate for repeated usage in an environment with alternative conditions over time must take into consideration aging of the double seal, exposure of the seal to varying environmental factors, and other stresses encountered by the plate. Therefore, measured results may vary and success rate can only be determined by the consequential effect on the object held within the water resistant central cavity.

Tests performed to determine the success rate of a protected or, sealed enclosure against the damaging effects of water ingress, are graded by way of an industry standard; the International Protection Rating system, often used to certify electrical enclosures. IP Codes, ranging from 0 (no protection from water ingress) to 8 (hermetically sealed or no harmful effects from water ingress), test enclosures under various conditions. IP Codes 1-4 imply an enclosure protected against vertically dripping water to water splashing at the enclosure from all directions. IP Codes 5-6 imply an enclosure against jets of water from all directions and at various distances and rates of force. IP Codes 7-8 imply an enclosure protected against immersion in water at various pressures and submerged for various lengths of time. An enclosure that passes a particular IP rating automatically confirms that it has passed alternative IP ratings of lower impermeability codes. It is the desire that the present plate is in compliance with industry standards, indicating an impermeable seal and water resistant central cavity, when tested in a controlled lab environment that simulates both hand washing and a dishwasher environment. It is therefore preferred that the plate herein has an IP rating of 8, or alternatively about 5-8, or still further alternatively about 3-8.

DETAILED DESCRIPTION

Figure 1:
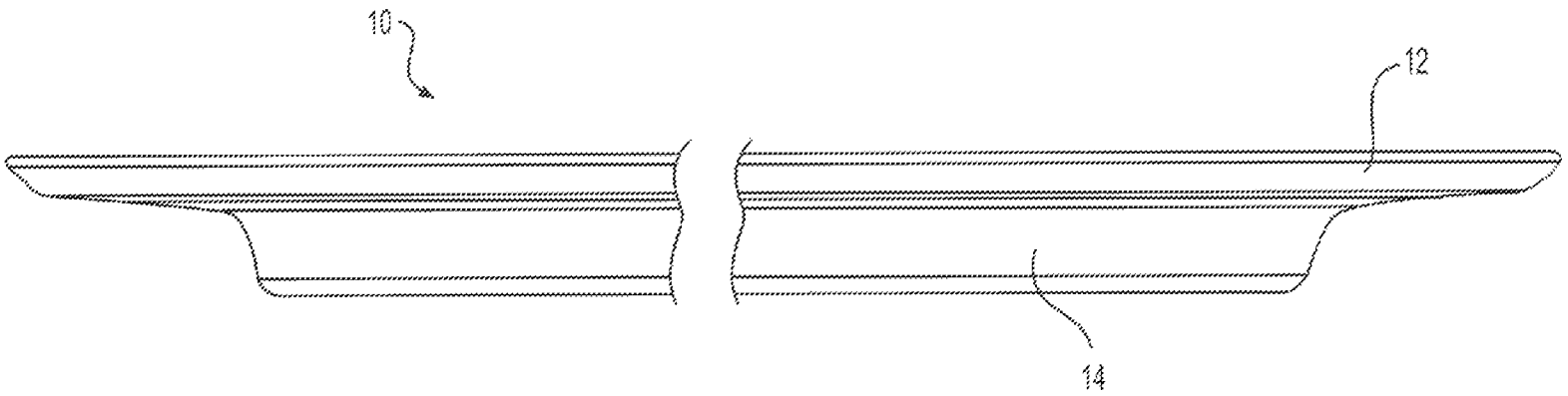
FIG. 1 is a side elevation view of a dining plate embodying an example described herein.

Referring now to examples of dinner plates described herein in more detail, in FIG. 1 there is shown the assembled plate 10 having a two part plate system consisting of a rigid, transparent top portion 12 and an elastomeric, non-transparent bottom portion 14. When assembled, the plate 10 may stand about 1 inch off of a flat, level surface.

Figure 2:
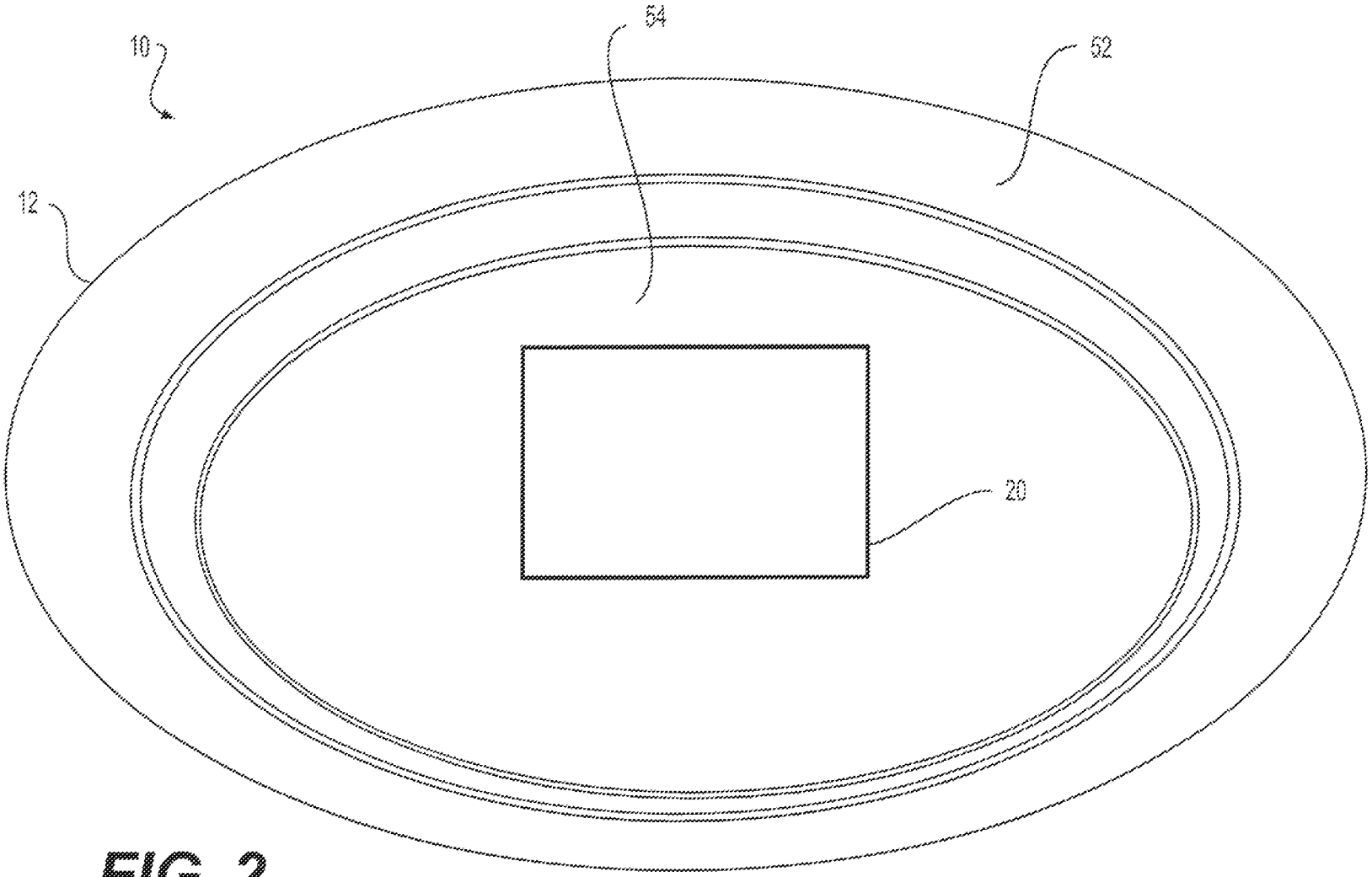
FIG. 2 is a perspective view looking down on the top of a plate in accordance with an example of the present invention.
Figure 3:
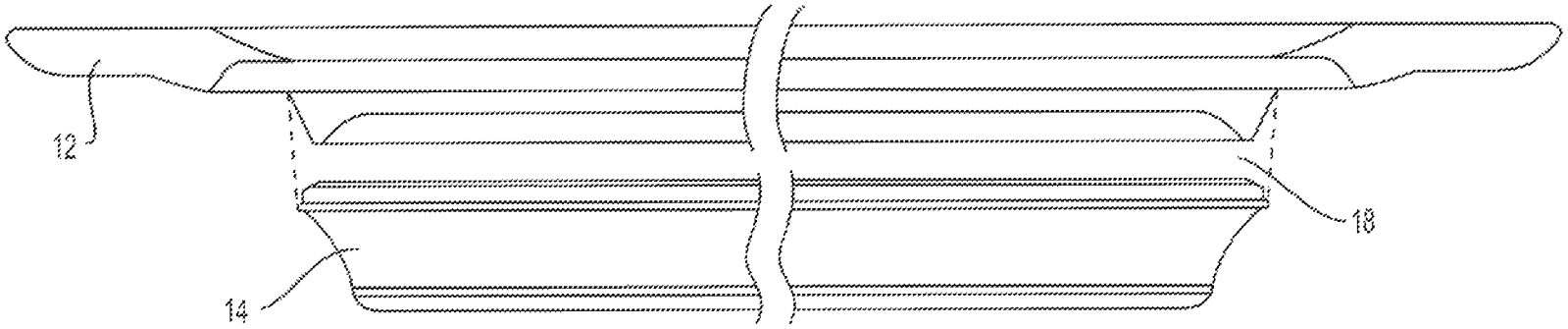
FIG. 3 is a side elevation, exploded view of the top and bottom portions of a dining plate in accordance an example of the present invention.

In further detail, referring to the plate in FIG. 2, the plate 10 has a substantially circular profile which is sufficiently proportioned for a meal. The top portion 12 is transparent such that the user can view a photograph or the like 20 through the transparent central circle section 54 during meals. The outer rim section 52 of the top portion 12 is also shown. FIG. 3 demonstrates where the central cavity 18 is located between the top portion 12 and the bottom portion 14 before assembly. The water resistant cavity 18 is created when the bottom portion 14 and the top portion 12 are pressed together, engaging an impermeable double seal connection. It is in the central cavity 18 that a photograph or the like is positioned between the top portion 12 and the bottom portion 14 of the plate during meals.

As noted above, the top portion 12 is completely transparent. Alternatively, the top portion 12 may be made of a translucent material or otherwise a partially transparent material. The top portion 12 may be opaque in part. The top portion 12 may also be tinted to be a particular color or colors. The top portion may include words or other artwork printed or otherwise inserted over a partial coverage of the surface of or in the top portion 12. For instance, words or other decorative indicia may be printed or spread across the area of the top portion 12. In addition to uniform transparency or tint or other designs, it is also possible to have a transparent window or windows in an otherwise opaque top portion 12. These window or windows may be completely transparent or, as described above, partially translucent or have other tint or artwork covering a portion of the surface of the window. The transparent window may be any shape or size to fit between a top and bottom portion of a dinner plate as described. There may be multiple windows, including different sized windows and different shaped windows. It is also possible to include some lighting components embedded in the top and/or bottom portion of the plate that could highlight or otherwise illuminate the photograph or other motivational indicia that would be placed in the cavity.

Figure 11A:
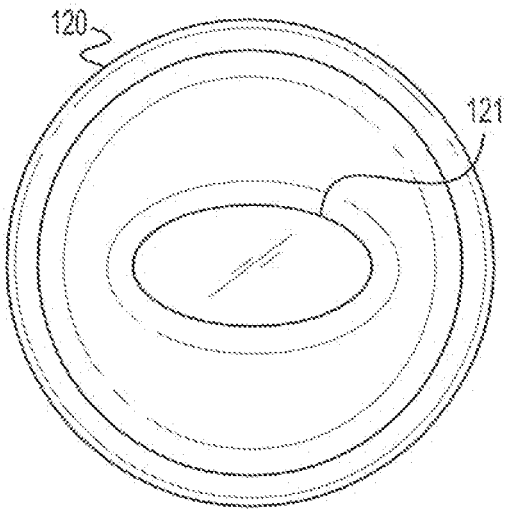
FIGS. 11A-11D are top views of a plate as described herein wherein the top portions have transparent windows as illustrated therein.
Figure 11B:
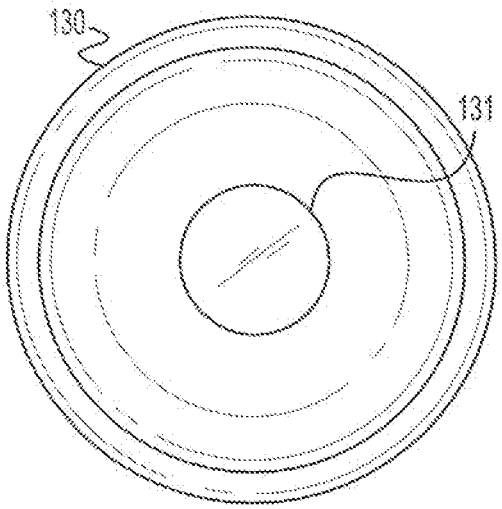
Figure 11C:
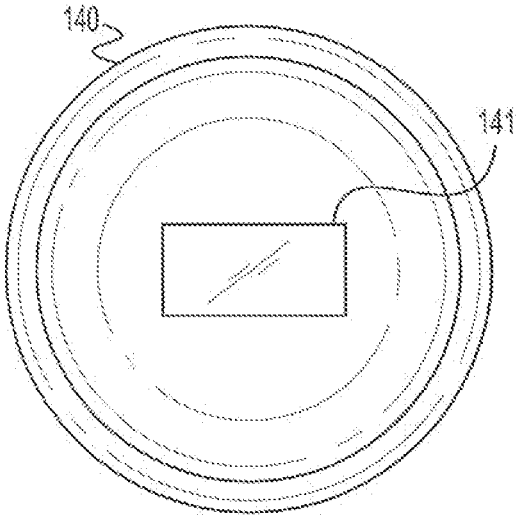
Figure 11D:
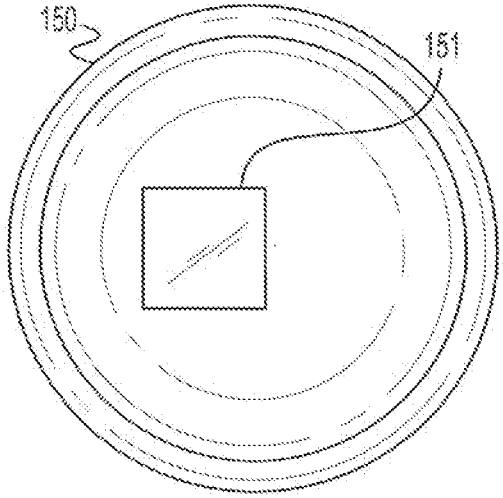
Figure 12A:
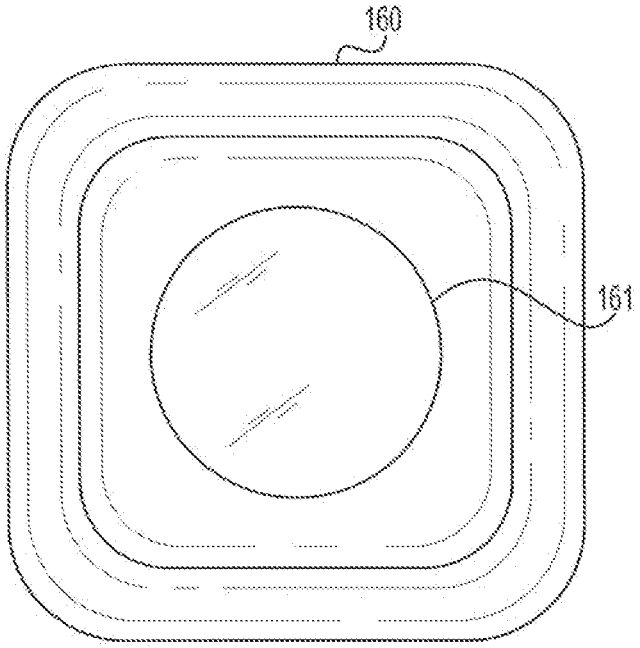
FIGS. 12A-12C are top views of plates embodying different geometries of the plate and of the transparent windows in the plates as described herein.
Figure 12B:
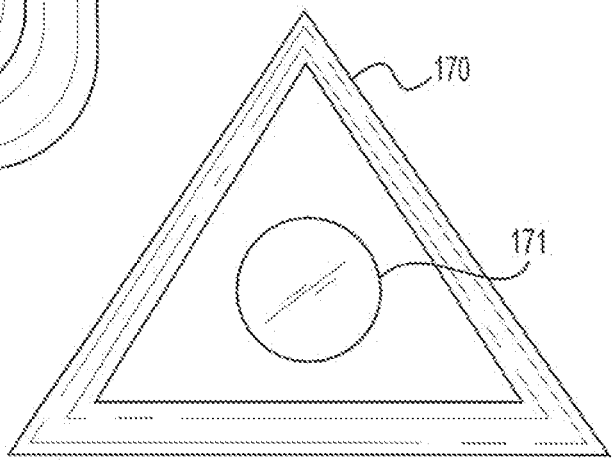
Figure 12C:
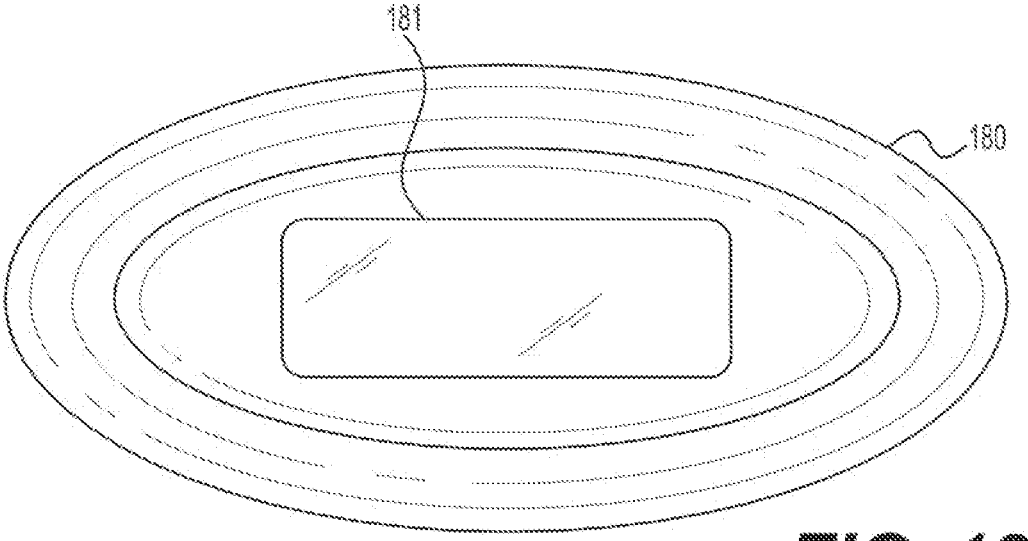

Examples of different window shapes and sizes are shown in FIGS. 11A-D and 12A-C. FIGS. 11A-11D each display round plates 120, 130, 140 and 150. In FIG. 11A, the window 121 has a generally oval shape. In FIG. 11B the window 131 is round and generally concentrically configured in the center of the round plate 130. In FIG. 11C, the window 141 is rectangular. In FIG. 11D, the window 151 is square and offset froth the center of the plate 150. In FIG. 12A, the rounded square plate 160 has a circular window 161 centered therein. In FIG. 12B, the triangular plate 170 has a round window 171 in the center thereof. In FIG. 12C and oval plate 180 has a rounded rectangular window 181 centered therein. It is clear that the windows may be positioned anywhere in the surface of the respective plates. Also, it is readily apparent that multiple windows could be configured in a plate surface.

The cavity 18 discussed herein can be an actual empty space that is molded or engineered in the top or bottom portion of the plate. Alternatively, it can just be the interface between the adjacent top and bottom portions, for instance, a photograph can be placed in between the top and bottom portions that then physically separates the top and bottom portions over the area of the photograph itself. Because a photograph is thin, it does not materially affect the seal, or the plate functionality. If larger, for instance thicker, objects are desired to be placed between the top and bottom portions, then a pocket or other space defining a cavity may be molded into the top or bottom portion to prevent any unwanted stretching or unevenness that would be caused by inserting the thicker object between the top and bottom portions.

Figure 4:
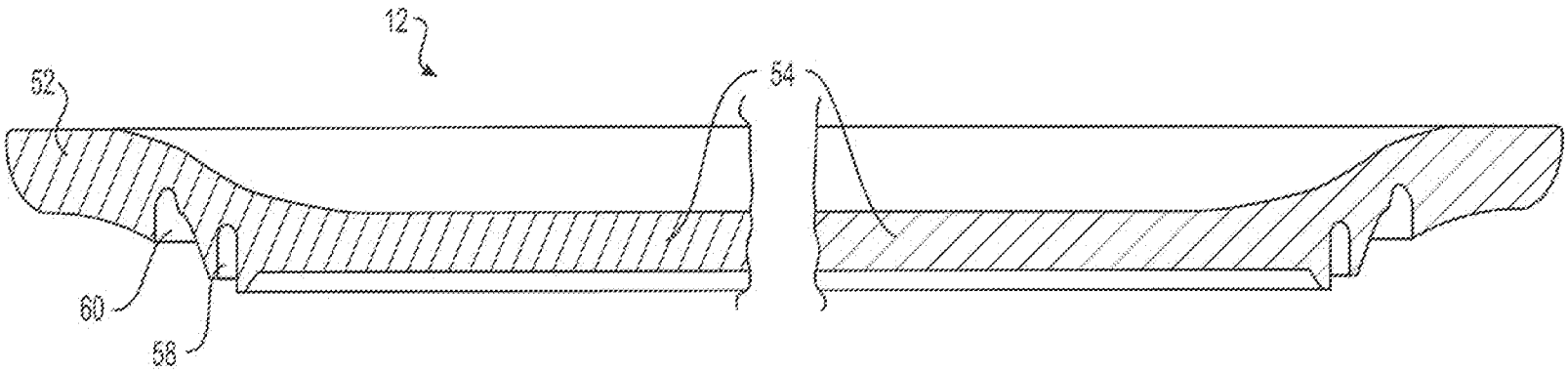
FIG. 4 is a side elevation cross-sectional view of the top portion of a dining plate as described herein.
Figure 5:
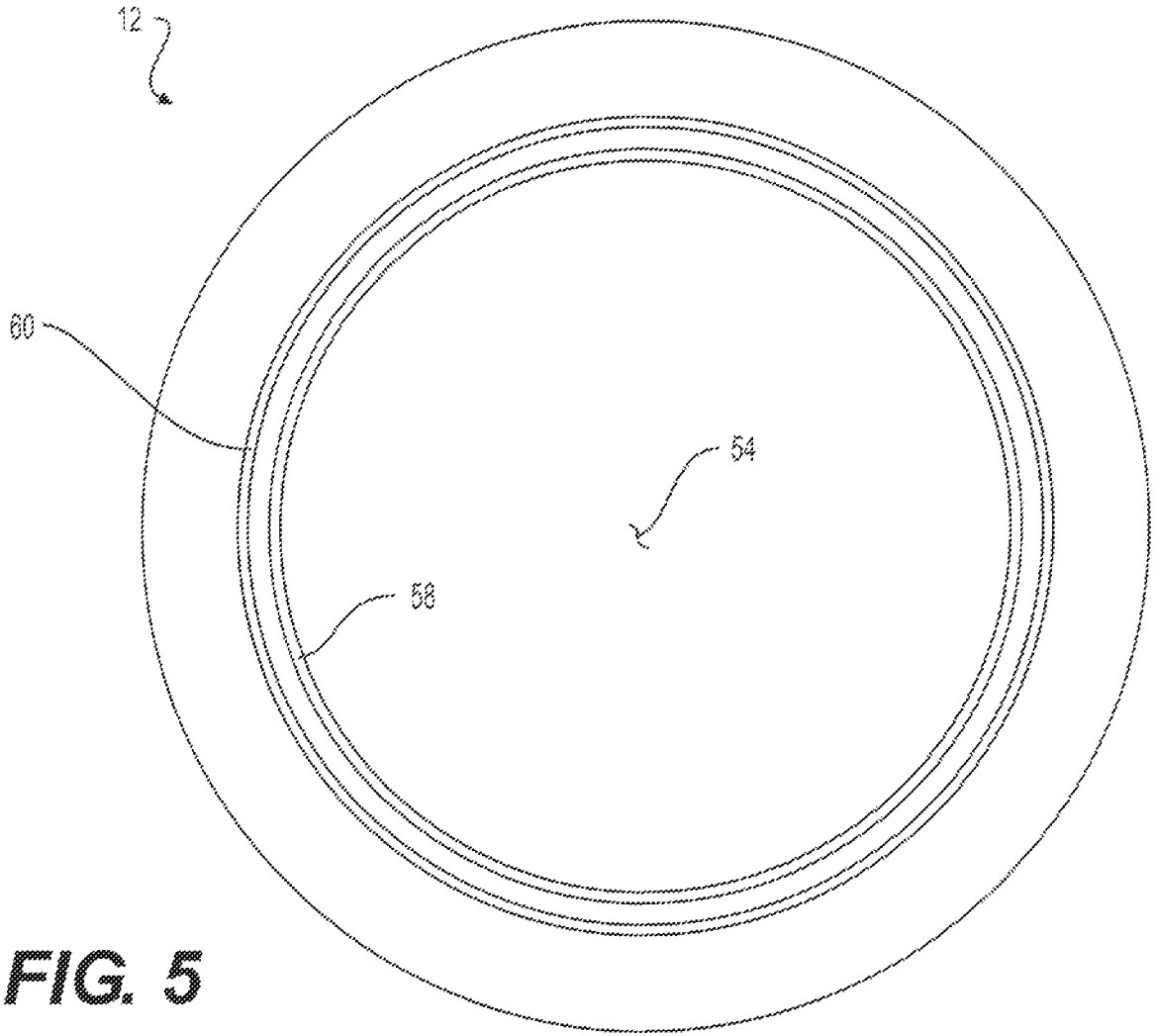
FIG. 5 is a bottom view of the top portion of the plate as described herein.

Referring now to FIG. 4 and FIG. 5, there is shown the transparent top portion 12. In FIG. 4, the cross-sectional view of the top portion 12 has an outer rim 52 and a transparent central circle section 54 of sufficient size upon which food may be consumed. Still referring to FIG. 4, the top portion receiving components for the double seal, preferably highly polished, are shown as the outside receiving groove 60 and the inside receiving grove 58. In FIG. 5, the bottom view of the top portion 12 shows a transparent central circle section 54 and the relative position of the double seal comprised of the continuous outside receiving groove 60 and the continuous inside receiving groove 58 that will receive the respective insertable counterpart components of the bottom portion 14 shown in FIG. 6, to create an impermeable double seal connection. The inside and outside grooves 58 and 60 (and therefore rib 112 and rim 114) are continuous and do not intersect.

In the drawings, the top portion 12 has the female receiving grooves 58 and 60, and the bottom portion 14 has the male rib 112 and rim 114 elements. It is possible according to this invention that a top portion may have male elements and the bottom portion has female grooves. It is possible for the top and bottom portions to have one each male element and female groove. The male elements are referred to as a rib 112 and a rim 114 simply for convenience. The terms "rib" and "rim" are interchangeable and refer to male elements. For instance the rim 114 may also be called a "rib", and the outward rim is shown as defining the outside circumference of the bottom portion 14. The rim 114 does not have to define the outside edge, as the bottom portion 14 may extend beyond where the male elements are positioned.

The construction details of the plate as shown in FIG. 4 and FIG. 5 include that the top portion 12 may be made of a sufficiently rigid, strong and transparent food grade material such as a high-strength plastic or glass, and the like. Several advantages to a sufficiently rigid, strong and transparent food grade, high-strength plastic exist. One is the compression and engagement of the bottom portion 14 components to the particular fit and finish of top portion 12 receiving grooves 58 and 60 to create an impermeable double seal and water resistant central cavity 18. Second, a rigid and transparent material adds the feature of a transparent surface through which a photograph or the like 20 can be viewed by the user at meal times or anytime of the user's choice. Third, a plate preferably has the feature of a BPA free material approved for use with food. Fourth, a rigid material adds the feature of a hard and durable surface to eat on that will resist scratches for an extended period of time. Fifth, a durable material adds the feature of resisting breakage if dropped.

The rigid transparent material for the top portion 12 is suggested in one example to be made of a copolyester material. Copolyesters can be molded into various applications resulting in an end product with excellent appearance and clarity and outstanding impact resistance. Molded copolyester products also have enhanced durability in the dishwasher environment, which can expose products to high heat, humidity and aggressive cleaning detergents. Select copolyesters may be used in repeated use food contact and are BPA free. One type of commercially available copolyester that could be used is Eastman Tritan Polyester TX1001 Clear. Of course other materials could also be used.

Figure 6:
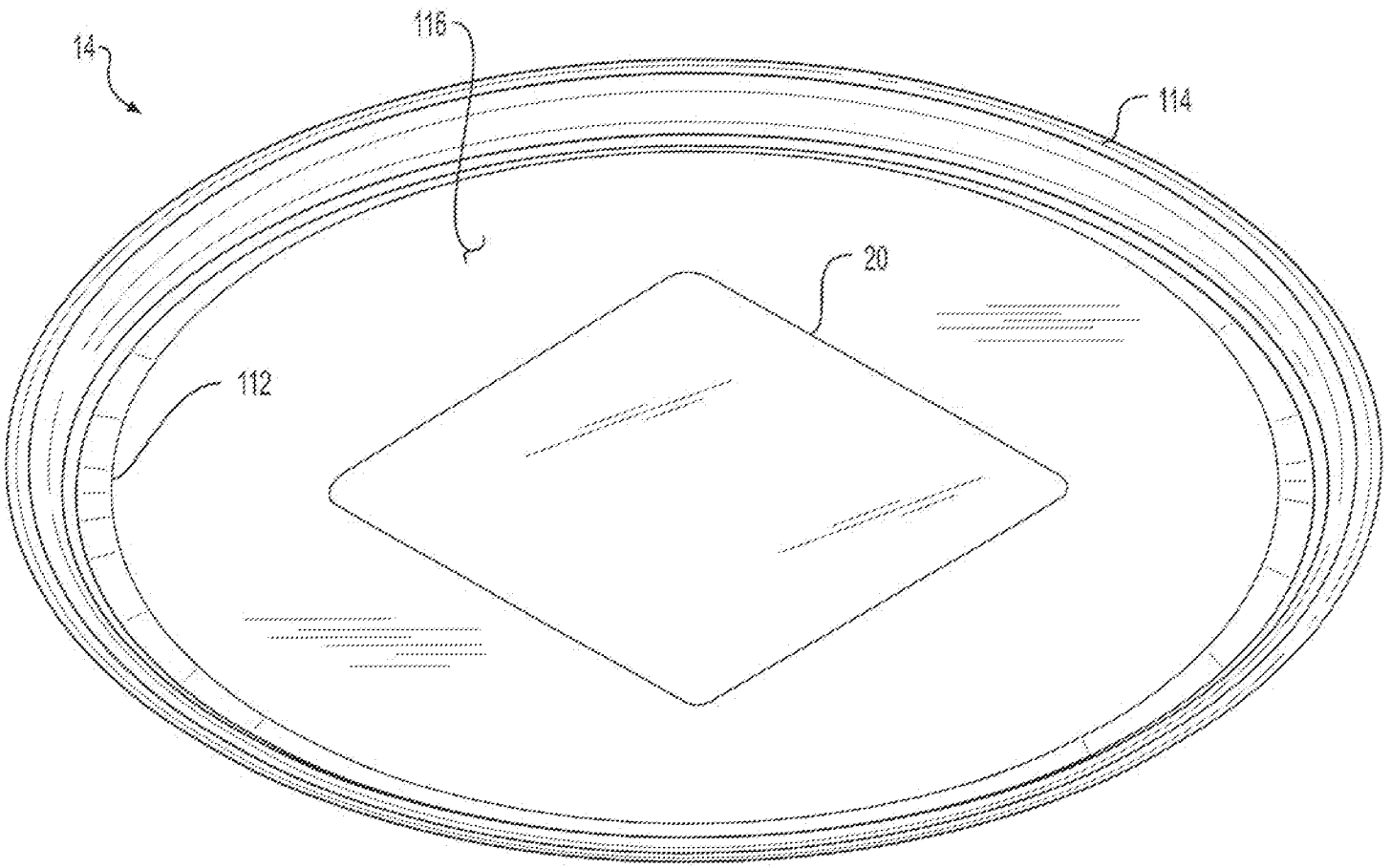
FIG. 6 is a perspective view of the top side of a'bottom portion of a plate as described herein.

Referring now to FIG. 6, the top perspective view of the non-transparent bottom portion 14 having a central circle portion 116 of sufficient size for a photograph or the like 20 to be placed upon it. The dimensions and placement of the insertable components of the bottom portion 14, consisting of the outwardly directed continuous rim 114 with a bulbous tip and a continuous inner standing rib 112, are determined and defined by the top portion 12 receiving components, specifically the continuous outside receiving groove 60 and the continuous inside receiving groove 58 shown in FIG. 5. These components together are constructed to conform and precisely fit each counterpart to create the impermeable double seal and water resistant central cavity.

Figure 7A:
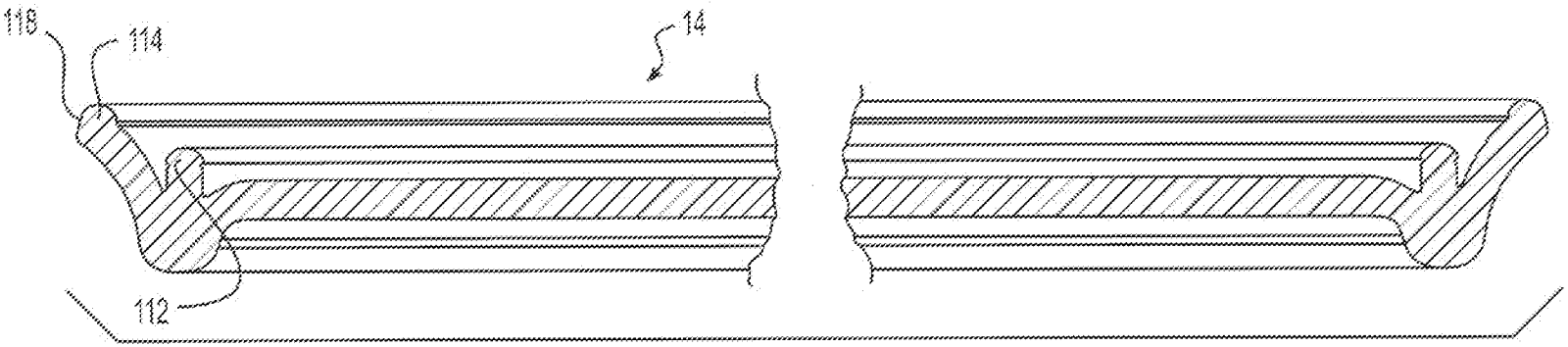
FIGS. 7A and 7B are side elevation, cross sectional views of the bottom portion of a plate as described herein.
Figure 7B:
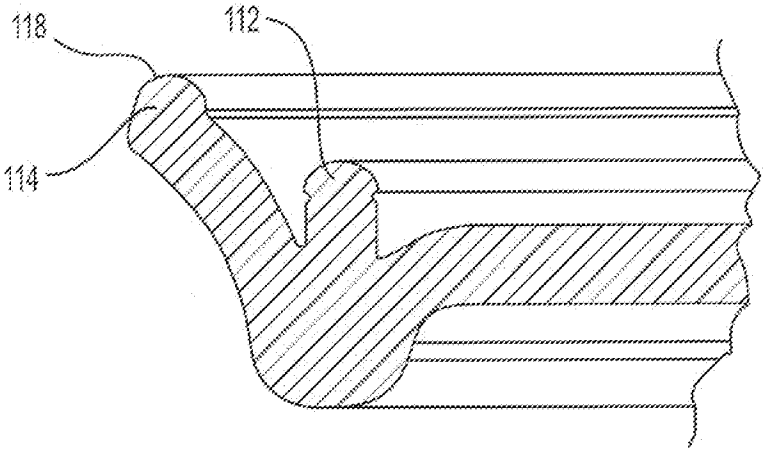

Referring now to FIGS. 7A and B, a cross-sectional view of the bottom portion 14, with an additional enlarged view, showing an outwardly directed continuous rim 114 with a bulbous tip 118, and a continuous inner standing rib 112. The bottom portion 14 has a substantially circular profile which is of a sufficient diameter to hold a photograph or the like 20 and determined and defined by the top components, the continuous outside receiving groove and the continuous inside receiving groove, to fit properly to form the double impermeable seal and a water resistant cavity.

The construction details of the invention as shown in FIG. 6 and FIGS. 7A and B are that the bottom portion 14 may be made of a non-flexible or flexible material such as, in one example, a high-strength elastomeric plastic, and the like. Several advantages to an elastomeric plastic for the bottom portion 14 exist. One is in the compression, engagement, fit and friction created between the bottom portion 14 components 112 and 114 to the top portion 12 grooves 58 and 60 to create the double impermeable seal connection. Second, an elastomeric plastic adds the feature of a 'no-slip' bottom portion so when the assembled plate shown in FIG. 1 is used at meal times the plate will remain positioned to the user's desired placement. Third, an elastomer adds the feature of not breaking if dropped. Fourth, an elastomer is a durable material that will sustain multiple uses and is easily gripped by the hand for removal from the top portion 12.

The compressible, non-transparent or transparent material for the bottom portion 14 is suggested to be made of an elastomer, more specifically a thermoplastic elastomer (TPE) or substance with similar qualities, to ensure proper compression into and engagement with the top portion 12 to form the double impermeable seal connection. Additional features of select elastomers include soft and flexible feel, excellent grip characteristics, good weatherability, easy processablity and colorability, use in a wide variety of applications including those where FDA compliance is required such as in use with food and beverage, and is BPA free. One example of an acceptable TPE is GLS Dynaflex TPE G 7970-1, with or without color concentrate. Of course other materials could be used as well.

Figure 8:
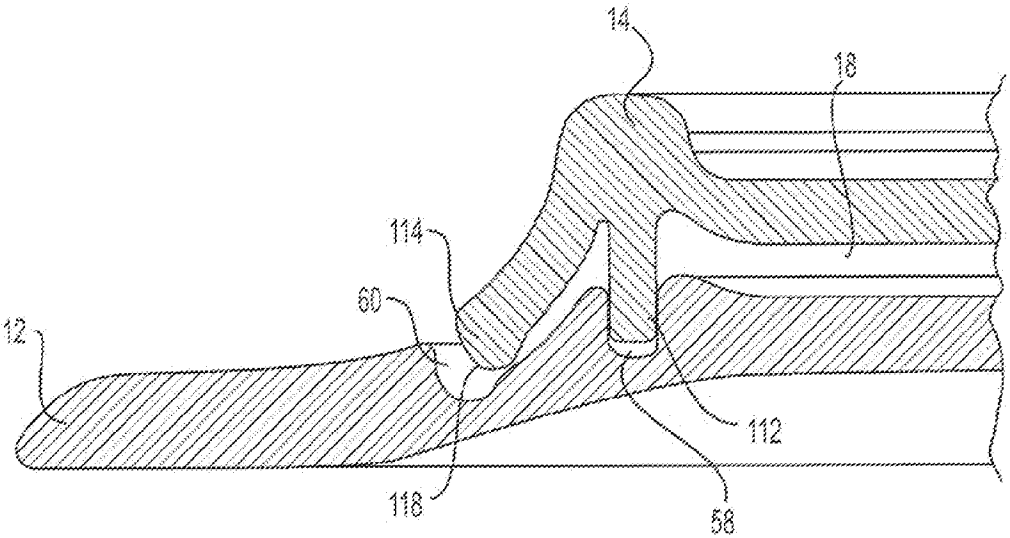
FIG. 8 is a side elevation, cross-sectional view of the top and bottom portions of a plate (in this view with the bottom portion, shown on top of the top portion of a plate).

Referring now to FIG. 8, fragmentary cross-sectional view of the press in double seal of the top portion 12 and the bottom portion 14 before assembly of the present invention, with the bottom portion 14 being inserted into the top portion 12. Bottom portion 14, male components shown in FIG. 8 include the outwardly directed continuous rim 114 with a bulbous tip 118 and a continuous inner standing rib 112, constructed to fit snugly into top portion 12 female receiving components, a highly polished outside receiving groove 60 and highly polished inside receiving groove 58, respectively. Additionally, FIG. 8 demonstrates the location of the water resistant central cavity 18 before the top portion 12 and bottom portion 14 are engaged.

Figure 9:
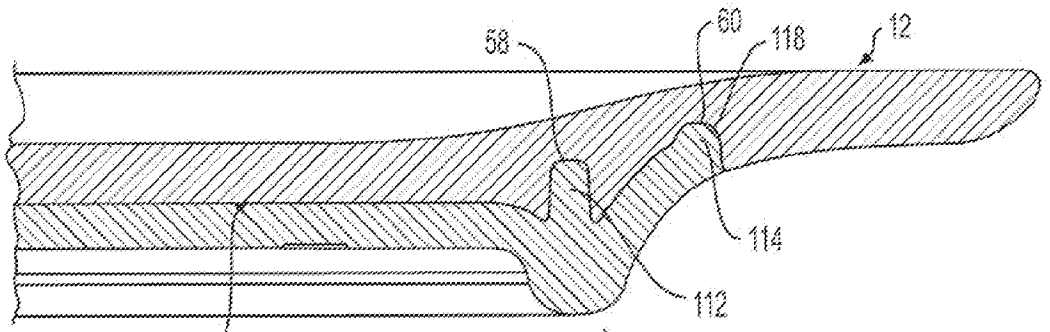
FIG. 9 is a side elevation, cross-sectional view of the top and bottom portions of a plate with the bottom portion fully inserted into the grooves of the top portion of the dinner plate.
Figure 10A:
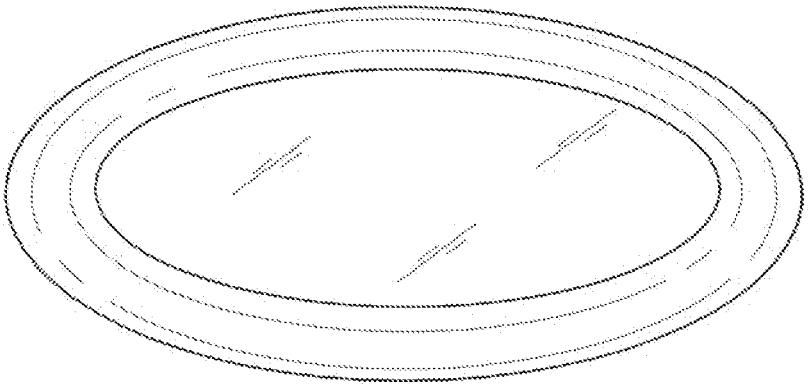
FIGS. 10A-10E are top views of alternative examples of dining plates as described herein wherein the top portion is made of a substantially transparent material.
Figure 10B:
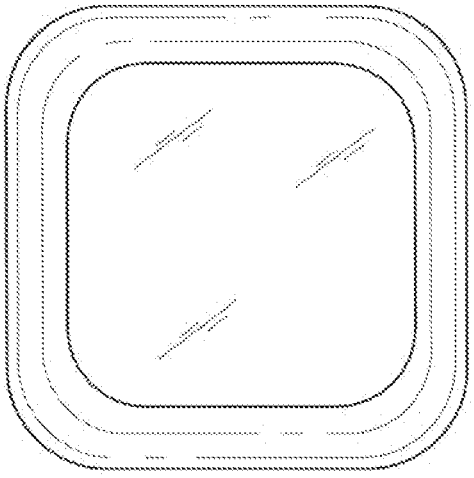
Figure 10C:
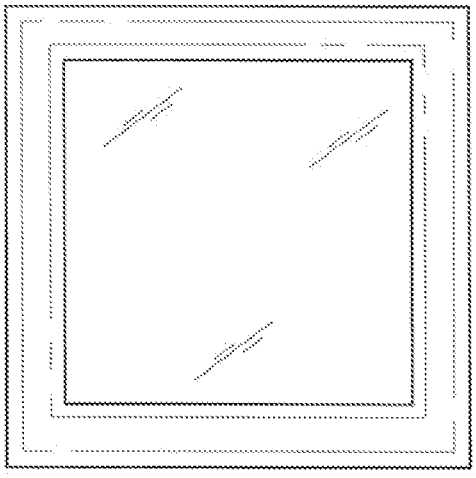
Figure 10D:
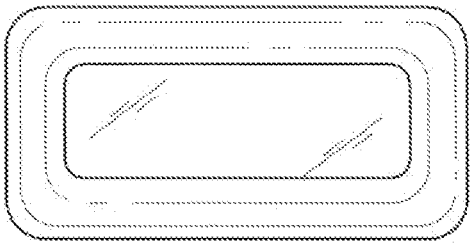
Figure 10E:
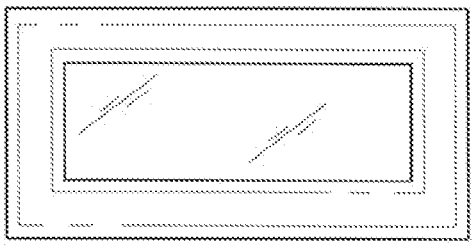

Referring now to FIG. 9, showing a cross-sectional view of an engaged, secure, impermeable double seal between components of the top portion 12 and the bottom portion 14 after assembly, creating a water resistant central cavity 18. Still referring to FIG. 9, the outer seal is achieved by the elastomeric bottom portion 14 outwardly directed continuous rim 114 with a bulbous tip 118 being compressed slightly into conformance with the shape of the highly polished receiving groove 60 of the top portion 12. The inner seal is achieved when using a particular elastomer, and a 10% compression that is viable and good between the opposed tips of a continuous inner standing rib 112 of the bottom portion 14 into a highly polished groove 58 of the top portion 12. In other words, the width of the standing rib 112 is approximately 10% greater than the width of the inside receiving groove 58 before the rib is inserted into the groove and compressed therein. The outward rim 114 may similarly have a larger width or size than the outside receiving groove 60 in order to obtain some compression of the rim 114 once it is inserted in the groove 60. It is the resiliency and distortability of the bottom portion 14 male components 112 and 114 that creates a live and impermeable double sealing and, therefore, different compression rates may be employed depending on the material chosen for the bottom portion 14 components 112 and 114 mating into the top portion 12 components 58 and 60. Some other elastomers with varying durometer may call for more or less compression of the material in the groove. For example a compression rate of 5-15% may accommodate a bottom portion 14 10-100 durometer range depending on Shore A or Shore D choice of raw materials. In one example about 50-80 Shore A, or alternatively about 30-90 Shore A, or still further alternatively about 10-100 Shore A bottom portion 14 material designed for the correct compression rate may work with a top portion 12 of about 30-100 Shore. D, or of 70-100 Shore D, or alternatively about 80-100 Shore D hardness. In one example the top portion has about a 100 Shore D hardness and the bottom portion has about a'70 Shore A hardness. The Rockwell hardness scale may alternatively be used to assess the hardness of the top portion 12. For instance, materials having a Rockwell hardness of 50-150 R, or alternatively 70-120 could be employed. The hardness differential between the top portion 12 and bottom portion 14 of the plate is crucial to consider when striving for optimal compression rate of the bottom portion 14 insertable components into the top portion 12 receiving components. While Shore D ratings are generally used to designate hard plastics, and Shore A ratings are generally used to designate elastomers, or softer plastics, the intent of the product is to create a seal which prevents water ingress by any combination of the top and bottom shores, in ratio to each other, which results in the previously discussed water impermeable IP code standards. Where the insertable male components of the bottom portion 14, an outwardly directed continuous rim 114 with a bulbous tip and a continuous inner standing rib 112, are slightly larger in width or size than the corresponding top portion 12 female receiving components, the outside receiving groove 60 and inside receiving groove 58. The seal is formed when the user presses a compressible material, the elastomeric bottom portion 14, into a rigid material, the copolyester top portion 12. The top plate could be produced out of almost any rigid material and the bottom portion could be produced out of silicone, rubber, or an elastomer. The essence of the fit, finish, compression and friction produced by the interaction of the top portion 12 and bottom portion 14 mating parts, and hence initiation of the double impermeable seal, may therefore work with a multitude of durometer differential ratios between the two plate portions if correctly proportioned to each other.

FIGS. 8 and 9 also illustrate how the particular seal in one example is achieved. In FIG. 8, the bottom portion 14 is shown only partially assembled with the top portion 12. As can be seen, the outer rim 114 is not aligned with the outside groove 60. However, as the rib 112 is fully inserted into the inside groove 58, the outside rim 114 is biased outwardly and into the groove 60. The outside rim 114 is therefore positively pressed into the outside groove 60 as a result of the flexible attribute of the bottom portion 14 flexible material. In this example, therefore, the elasticity or flexibility of the material enhances the seal of the bottom portion 14 to the top portion 12.

The examples discussed herein are directed to a double seal configuration. It is believed that the double seal is the best barrier to fluid entry into the cavity described herein. However, it is at least possible that a single groove and corresponding male element configuration could achieve a substantially impermeable seal that is made to be taken apart and reassembled as the present invention. The mate element and groove may be similar to either one or both of receiving grooves 58 and 60 or male elements 112 and 114.

To assemble the plate shown in FIG. 1, the user places the top portion 12 top side down so it appears as in FIG. 5 bottom view up, on a flat level surface. The user places a motivational picture or photograph or the like 20 face down on the back side of the top portion 12 within the transparent central circle section 54. The user fits the front view of the bottom portion 14 shown in FIG. 6 over the back side of the top portion 12 shown in FIG. 5, ensuring the components 112 and 114 of the bottom portion 14 fit properly and easily within the components of the top portion 12 components 58 and 60 as shown in FIG. 8. The user applies pressure with the heel of their hand around the inner circle circumference and outer rim circumference of the bottom portion 14 to engage components 112 and 114 of the bottom portion 14 into the receiving components 58 and 60 respectively of the top portion 12 to create the impermeable double seal for a secure connection shown in FIG. 9. The user turns the assembled plate upright so the top portion top view shown in FIG. 2 is facing up and the photograph or the like 20 is visible through the transparent, top portion 12 central circle 54. The assembled plate is now ready for use during a meal or other purpose of the user's choice.

A further feature of the invention resides in the provision of top portion and bottom portion of the above characteristics which may be molded by compression or injection. Such manufacturing techniques can yield a product that is economical to manufacture, durable, efficient, and capable of repeated use.

However, this invention further contemplates a top portion made out of almost any rigid material such as glass, composition, metal and other materials having, however, a receiving groove and receiving concentric rib system made of a highly polished copolyester, and; an applicable bottom portion made out of almost any material such as glass, composition, metal, silicone, rubber and other materials having, however, an outer rim and single standing rib made of an elastomer or of any other non-metallic substance having similar physical properties or similar durometer components. If using plastic composition materials, durometer choices for the top portion and bottom portion can vary, as previously discussed. However, it is the durometer proportional ratio between the two portions that effect the seal engagement, also as previously discussed. Additionally, you could choose a lion-transparent material for the top portion, however you may defeat the intent or purpose of the plate if the top portion central circle is non-transparent.

The discussion herein is directed to an example of a plate. The present invention is also directed to a kit for forming the plate described herein. For example, the kit may include the top portion as described and the bottom portion as described in separate or unattached relationship. It is possible to have kits that include a single bottom portion and multiple top portions. Similarly, it is possible to have a kit that includes a single top portion and multiple alternative bottom portions. Finally, it is also envisioned to have a kit that includes multiple top portions and multiple bottom portions. The different components that would be included in each kit could have different colors or shapes or other artwork that is incorporated there. In order to be sufficiently interchangeable, it only necessary that the geometry and spacing of the inside and outside receiving grooves and the standing rib and outward rim are consistent throughout. This would allow any top portion to be used in connection with any bottom portion to create the sealed cavity into which motivational indicia could be inserted.

The advantages of the present invention include, without limitation: it is a standard size plate to consume meals from, and when assembled properly by engaging the connection between the bottom portion and the top portion, creates an impermeable double seal and a water resistant central cavity to receive a singular or plural picture or photograph, or the like that can be viewed, by the user through the transparent top portion of the plate during meals or any time of the user's choice.

The top and bottom portions of the plate are easily assembled and separated without excessive force. Insertion of a photograph or the like can be done without excessive force. The assembled plate, during meals or any other time of the user's choice, is constructed for repeated use. The two part plate can be cleaned by hand or in a dishwasher. Additionally, the two parts can be cleaned individually or in the assembled state.

The discussion herein makes reference throughout to a plate. The actual structure of the plate can take as many forms as there are styles of plates that are used at present. The plate May be substantially flat; the plate may have a curved up side. The plate may have a symmetric construction or an asymmetric profile or shape. The plate May be round, oval, square, rectangular or triangular. The plate may be what is commonly referred to as a dinner plate, luncheon plate, salad plate, roll plate, tea saucer, or any other dish for eating from. For the purposes of this application; the term "plate" also refers to bowls and other eating dishes.

Further a plate comprises, when assembled, displaying a photograph or the like of the user's choice. This plate provides a method of motivating weight loss, maintaining current weight or in general motivating a user towards increased physical activity and a healthier lifestyle. The motivational image seen through the transparent top portion of the dinnerware becomes a visual reminder while consuming food, in that it prevents the user from forgetting his or her "best self" goal. Therefore, the user is visually reminded of his or her physical shape, initiating healthy food choices and proportions, which will result in a change or maintenance of that visualization of the user's body shape. The enclosed picture or the like can be changed as often as desired.

Further, it comprises a bottom portion of the dinnerware and a top portion to cover the motivational image and when assembled, properly; provides a unique impermeable double seal connection between the two portions and a water resistant central cavity to protect the object from moisture within the central cavity.

The water resistant central cavity created by the proper engagement of the impermeable double seal between the top portion and bottom portion herein may be used in the display of most any media or motivational indicia such as a photograph or the like, including but not limited to a photocopy, magazine clip, newspaper clip; document, article, sketch, drawing, invitation, certificate, diploma, keepsake, or other objects, etc. Further, the top portion and bottom portion described herein may therefore hold within the water resistant central cavity any object such that the item chosen is not of greater thickness or diameter than the water resistant central cavity dimensions so as to allow the impermeable double seal to press in and seal properly.

The intent is for the user to choose an object which will serve as a reminder to adhere to an individually chosen nutritional or physical regimen to assist her or him in attaining or maintaining their "best self" personal goal. Therefore, the object can be anything that reminds, motivates, inspires, encourages, induces, provokes or stimulates the user to take action to meet his or her personal goal. The plate 10 may function for any desired purpose, but as shown, the plate 10 therefore also serves as an impermeable enclosure for a photograph or the like 20 to be viewed during meal times with the intent of being, a visual reminder for the user to meet a personal "best self" goal, of whatever their personal goal may be.

Often times, driven by the media's influence, the weight loss industry covers a very broad spectrum of "guaranteed programs". It is believed that these programs are often abandoned because "failure is simply due to forgetting". The two-piece "plate system" described herein is an economical, self-motivating weight loss aid, which does not allow the user to forget his or her individual goal. The described two-piece dining system displays the user's photo or the like. It is intended to be a visual reminder to aid the user in his or her weight loss goal, or in motivating increased physical activity and a healthier lifestyle through this visual prompt. "You won't fail, because you won't forget". Essentially, by means of the user's photo or the like being integrated into the plate, the user gives himself or herself permission to become his or her own motivation.

The "plate system" is intended to be used in conjunction with the user's established food program, or alone, in the assumption that the user already has knowledge of "what to eat and when to eat it". The invention diminishes the exterior media's determination of accepted body types, by shifting that determination to the user of the plate. The user now determines his or her own acceptable body shape, and chooses to maintain it or change it.

Much of the above discussion has been focused on motivational indicia like photographs such as personal photographs. However, other motivational indicia, including combinations of various indicia, could be used. From a very simple and sensible perspective, the motivational, indicia may include, at least in part, specific process information regarding a diet that includes portion control, calorie counts for foods, or similar fundamental information. Alternatively, the indicia may include motivational words, phrases or passages. The indicia may be handwritten. The indicia may include drawings or other artwork. It is easy to imagine combinations of the foregoing indicia that could be used together. One example of a diet method that could be used includes the use of a sequence of photos or messages in the same or multiple windows on a plate. This sequence of indicia could be used in combination of the shape, color, lighting or other variables of the plate and transparent window. From a commercial standpoint, there are opportunities for marketing for commercial diet programs that could include some general, generic information and still allow a user to insert personal indicia such as photos or drawings or clippings. A creative diet planner can imagine multiple ways to use a plate having the flexibility of the plate described herein to use in combination with a diet.

In addition to being used as a diet tool, the plate described herein could easily be used also for festive or memorable occasions including weddings and anniversaries. Personal photographs or other mementos could be inserted in the cavity in the plate. The plates could be customized for particular guests. The plates could have multiple pictures of past events such as, parties, birthdays, weddings, or other occasions. The plate, therefore, becomes a uniquely customizable tool for a party giver or caterer.

EXAMPLE

In one example, the dining plate is around plate having an outside diameter of eleven inches. This is the outside diameter of the top portion of the plate. The top portion is made of Eastman Tritan Polyester TX1001 Clear polyester material. In the center portion of the plate, the plastic material is approximately 0.17 inches in thickness. This top portion of the plate includes a round, continuous inside receiving groove that is approximately 0.150 inches deep and 0.120 inches in width. From the bottom to the top of this inside groove, the walls flare outwardly at approximately a five degree slope total (the draft is about 2.5 degrees per side). The top portion also includes an outside receiving groove that has a width of about 0.150 inches and a depth of about 0.150 inches.

The bottom portion of the plate has an outside diameter of about nine inches. The inside male portion, also referred to as a standing rib, has a height of 0.125 inches and a width of 0.14 inches. The outer rim or second male portion has a width of approximately 0.155. This bottom portion is made of GLS Dynaflex TPE G 7970-1 polymer. The central portion of the polymer is approximately 0.15 inches thick.

I wish it understood that minor modifications, incorporations and/or variations in the materials, construction, shape, size, profile, appearance, and position, of parts described herein of the top portion and bottom portion, individually or assembled, may all be options without abandoning the spirit of the invention and the scope of descriptions herein. Therefore, the so described specifications of the invention encompass the spirit of the present invention. Modifications to the integration of material choice, geometry alteration, both to the top and bottom portions, individually, as well as the seal between the two, will be established for quality manufacturing purposes and will not alter the intent and spirit of the present invention.

The advantages of the present invention are not limited to the aforementioned descriptions and examples of use, but encompass all individual methods of use that can be employed or deemed, useful. Outside the embodiment of what has been described, the plate can be used at the user's discretion for several purposes, for example, the invention is portable and can be used at home or away from home. The invention can be used inside or outside, in varying temperatures, for picnics or poolside, as the central cavity is moisture resistant due to its impermeable seal. When not assembled, the tap and bottom portions can be utilized as separate entities. The top portion is not reliant on the bottom portion, if the user desires to use it as a traditional dining plate. When not employed for dining purposes, the invention can be tilted to the upright position and placed, for instance, on a kitchen counter, one's desk, night table, dressing table, exercise area, beside a mirror, or a location where the user spends a lot of time; for continual visual reminder and motivation. The bottom portion prevents the plate from slipping from a high chair tray or a nursing home/hospital table, for use by all ages, and as it is also BPA free, can be used as a plate in and of itself. During the manufacturing process, the top portion can be customized by adding color concentrate whereas the concentrate can create a semitransparent, sparkle, or tinted effect to accommodate the user's preference. The manufacturing tool can be adapted to accommodate endless possibilities of text or art, for purposes of individualizing the outer rim of the top portion of the plate or the inner circle of the bottom portion of the plate.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A dining plate:

a top portion comprising:

at least a partially transparent portion, and a bottom surface comprising:

a continuous outside receiving groove, and a continuous inside receiving groove, wherein the outside receiving groove and the inside receiving groove are non-intersecting;

a bottom portion having a generally planar shape that corresponds generally to a groove shape defined by the outside and inside receiving grooves, wherein the bottom portion comprises a flexible material that is softer and more compressible relative to the top portion, the bottom portion comprising a top surface comprising;

an outwardly directed continuous rim comprising a bulbous tip and positioned such that the outwardly directed continuous rim aligns with the outside receiving groove, wherein the outwardly directed continuous rim is angled outward from a central portion of the bottom portion, and a continuous inner standing rib positioned such that the continuous inner standing rib aligns with the inside receiving groove, wherein the inner standing rib is perpendicular to the central portion of the bottom portion;

wherein the top and bottom portions are joined together so that the inner standing rib is releasably positioned in the inside receiving groove and the outwardly directed continuous rim is releasably positioned in the outside receiving groove such that the bulbous tip is compressed within the outside receiving groove, thereby defining a watertight seal between the top portion and the bottom portion, wherein the watertight seal has an IP water ingress rating of 3 or greater;

wherein a substantially watertight cavity is formed between a central section of each of the top and bottom portions such that an insertable component may be positioned between the top portion and the bottom portion, and wherein the watertight seal is configured to disconnect via hand manipulation of the bottom portion, thereby providing for removal of the insertable component.

2. The dining plate described in claim 1, wherein the shape of the top and bottom portions is proportionally the same, and the shape is selected from the group consisting of a circle, oval, square and triangle.

3. The dining plate described in claim 1, wherein the shape of the inner standing rib is selected from the group consisting of a circle, oval, square and triangle.

4. The dining plate described in claim 1, wherein the shape of the outwardly directed rim is selected from the group consisting of a circle, oval, square and triangle.

5. The dining plate described in claim 1, wherein a size and shape of the outside receiving groove are substantially the same as a size and shape of the outward rim.

6. The dining plate described in claim 1, wherein the partially transparent portion comprises a plurality of transparent windows in its central section.

7. The dining plate described in claim 1, wherein a Shore A Hardness Durometer of the bottom portion of the plate is 50-80 and a Shore D Hardness Durometer of the top portion of the plate is 70-100.

8. The dining plate described in claim 1, wherein a Shore A Hardness Durometer of the bottom portion of the plate is about 50 and a Shore D Hardness Durometer of the top portion of the plate is about 70.

9. The dining plate described in claim 1, wherein the seal formed between the top and bottom portions of the plate has an IP water ingress rating of 5 or greater.

10. The dining plate described in claim 1, wherein the top and bottom portions are both free of BPA.

11. A method of providing a personalized experience for dieting or other pesonalized dining experience, the method comprising:

providing a dining plate comprising:

a top portion comprising:

at least a partially transparent portion, and a bottom surface comprising:

a continuous outside receiving groove, and a continuous inside receiving groove, wherein the outside receiving groove and the inside receiving groove are non-intersecting, a bottom portion having a generally planar shape that corresponds generally to a groove shape defined by the outside and inside receiving grooves, wherein the bottom portion comprises a flexible material that is softer and more compressible relative to the top portion, the bottom portion comprising a top surface comprising:

an outwardly directed continuous rim comprising a bulbous tip and positioned such that the outwardly directed continuous rim aligns with the outside receiving groove, wherein the outwardly directed continuous rim is angled outward from a central portion of the bottom portion, and a continuous inner standing rib positioned such that the continuous inner standing rib aligns with the inside receiving groove, wherein the inner standing rib is perpendicular to the central portion of the bottom portion, wherein the top and bottom portions are joined together so that the inner standing rib is releasably positioned in the inside receiving groove and the outwardly directed continuous rim is releasably positioned in the outside receiving groove such that the bulbous tip is compressed within the outside receiving groove, thereby defining a watertight seal between the top portion and the bottom portion, wherein the watertight seal has an IP water ingress rating of 3 or greater, thereby defining a cavity between the top portion and the bottom portion; and inserting into the cavity a motivational indicia relating to the process or goal of a diet;

whereby a user of the plate containing the motivational indicia is reminded of the diet.

12. A method of providing a personalized experience for dieting or other personalized dining experience as described in claim 11, wherein the plate comprises a plurality of windows in the top surface thereof and a corresponding waterproof cavities there behind; and inserting a plurality of motivational indicia in a corresponding plurality of the cavities to display those indicia to the users of the plate.

13. A method of providing a personalized experience for dieting or other personalized dining experience as described in claim 11, wherein the motivational indicia are removably inserted into the waterproof cavity;

whereby the user may change the indicia at their discretion.

14. A method of providing a personalized experience for dieting or other personalized dining experience as described in claim 11, wherein the motivational indicia is a picture.

15. A method of providing a personalized experience for dieting or other personalized dining experience as described in claim 11, wherein the motivational indicia is a picture of the user.

16. A method of providing a personalized experience for dieting or other personalized dining experience as described in claim 11, wherein the motivational indicia is a written message regarding diet facts.

17. A kit for assembling a dining plate, the kit comprising:

the a top portion comprising:

at least a partially transparent portion, and a bottom surface comprising:

a continuous outside receiving groove, and a continuous inside receiving groove, wherein the outside receiving groove and the inside receiving groove are non-intersecting;

a bottom portion having a generally planar shape that corresponds generally to a groove shape defined by the outside and inside receiving grooves, wherein the bottom portion comprises a flexible material that is softer and more compressible relative to the top portion, the bottom portion comprising a top surface comprising;

an outwardly directed continuous rim comprising a bulbous tip and positioned such that the outwardly directed continuous rim aligns with the outside receiving groove, wherein the outwardly directed continuous rim is angled outward from a central portion of the bottom portion, and a continuous inner standing rib positioned such that the continuous inner standing rib aligns with the inside receiving groove, wherein the inner standing rib is perpendicular to the central portion of the bottom portion;

wherein the top and bottom portions are adapted to be joined together so that the inner standing rib is releasably positioned in the inside receiving groove and the outwardly directed continuous rim is releasably positioned in the outside receiving groove such that the bulbous tip is compressed within the outside receiving groove, thereby defining a watertight seal between the top portion and the bottom portion, wherein the watertight seal has an IP water ingress rating of 3 or greater;

wherein a substantially watertight cavity is adapted to be formed between a central section of each of the top and bottom portions such that an insertable component may be positioned between the top portion and the bottom portion, and wherein the watertight seal is adapted to disconnect via hand manipulation of the bottom portion, thereby providing for removal of the insertable component.

18. A kit as described in claim 17, further comprising a plurality of top portions.

* * * * *